US005514039A

United States Patent [19]

Gendron et al.

[11] Patent Number: 5,514,039

[45] Date of Patent: May 7, 1996

[54] BALL STRIKING CUE WITH SELF-LOCKING CONICAL JOINT

[76] Inventors: Alain Gendron, 154 boul. Brousseau, East-Angus, Québec, Canada, J0B 1R0; Luc Gendron, 2400 Des Mélèzes, Fleurimont, Québec, Canada, J1G 4M9

[21] Appl. No.: 254,539

[22] Filed: Jun. 6, 1994

[51] Int. Cl.[6] ..... A63D 15/08

[52] U.S. Cl. ..... 473/44

[58] Field of Search ..... 473/44, 46, 48; 273/81 R, 81.2, 86 R, 80.2, 80.8, 80.9, 44, 46, 48; 135/65, 69, 75, 76, 911; 403/143, 144, 149, 367, 368; 43/18.1, 23

[56] References Cited

U.S. PATENT DOCUMENTS

| | | | |
|---|---|---|---|
| 222,681 | 12/1879 | Earle | 43/18.1 |
| 264,243 | 9/1882 | Chubb | 43/18.1 |
| 1,199,082 | 9/1916 | Jost . | |
| 1,287,215 | 12/1918 | Campbell . | |
| 1,440,953 | 1/1923 | Atkins . | |
| 1,525,910 | 2/1925 | Blair . | |
| 2,044,092 | 6/1936 | Manzeck | 473/48 |
| 3,436,079 | 4/1969 | Berry et al. | 273/68 |
| 4,067,133 | 1/1978 | Livingston | 43/18.1 |
| 5,351,703 | 10/1994 | Moe et al. | 135/76 |

FOREIGN PATENT DOCUMENTS

| | | | |
|---|---|---|---|
| 1100062 | 9/1955 | France | 43/18.1 |
| 1104188 | 11/1955 | France | 43/18.1 |
| 2698239 | 5/1994 | France | 43/18.1 |
| 2172210 | of 0000 | United Kingdom | 473/48 |
| 447270 | 5/1936 | United Kingdom | 273/81 |
| 608240 | 9/1948 | United Kingdom | 473/48 |
| 2160784 | 1/1986 | United Kingdom | 473/48 |

*Primary Examiner*—Theatrice Brown

[57] ABSTRACT

A ball striking cue comprises a butt section, a shaft section, and a self-locking joint for removably interconnecting the butt and shaft sections end to end. The joint includes the proximate end of the shaft section formed with a conical hole, and the proximate end of the butt section formed with a conical extension. These hole and extension constitute the unique point of contact between the butt and shaft sections. They have complementary shapes and the hole has smaller radial dimensions than the extension whereby the extension can be forced in the hole to press fit the extension in the hole and thereby removably interconnect the butt and shaft sections with a spacing between the bottom of the hole and the free end of the extension. The conical hole and extension widens out and tapers, respectively, at an angle which is function of the nature of their material to enable press fit and retention of the extension in the hole while enabling separation thereof by forcing them axially apart from each other. To facilitate separation of the hole and extension, the proximate end of the butt section has a threaded cylindrical surface on which an internally threaded sleeve is mounted, and the proximate end of the shaft section has an annular abutment surface facing one end of the sleeve whereby the sleeve is rotated to abut against the annular surface and spread the hole and extension apart form each other.

1 Claim, 2 Drawing Sheets

BALL STRIKING CUE WITH SELF-LOCKING CONICAL JOINT

BACKGROUND OF THE INVENTION

1. Field of the Invention

The present invention relates to a ball striking cue comprising butt and shaft sections that can be dismantled. More specifically, the ball striking cue according to the invention comprises a self-locking joint for removably interconnecting the butt and shaft sections end to end.

2. Brief Description of the Prior Art

Ball games such as pool, carom billiards and snooker are played with a ball striking cue. These games are played on a table comprising a baize-covered horizontal surface surrounded by a cushion mounted on a peripheral rail.

In the case of pool and snooker, the table further comprises four corner pockets as well as two side pockets. The ball striking cue is used to strike a cue ball for thereby projecting that ball toward a second ball directly or through at least one bounce on the cushion. The cue ball then strikes the second ball to move the latter ball toward one of the pockets directly or through at least one bounce on the cushion.

For many reasons that will be apparent to those of ordinary skill in the art, the above mentioned ball games require transfer of a precisely controlled level of energy from the ball striking cue to the cue ball at each play; a successful play may require either power or restraint depending on the particular circumstances.

At each play, a player must not only pocket a ball but also place the cue ball in view of pocketing another ball at the next play. A player has therefore to develop a skill to determine precisely the energy required each time it strikes the cue ball. As a precisely controlled level of energy is transferred to the cue ball through the ball striking cue at each play, the cue should be a precise instrument having specific properties.

Generally speaking, the quality of a ball striking cue is function of two properties: its "response" and its "resonance". When an equilibrium between these two properties is reached, it is said that the ball striking cue has a good "feeling".

The "response" of a ball striking cue is good when the energy from the arms and hands of the player is efficiently transferred to the cue ball. With no energy loss involved, it is easier to produce effects such as back spin, top spin and side spin of the cue ball since the player has not to compensate for the loss of energy in the ball striking cue. This prevents a player to overcompensate or undercompensate the loss of energy in the cue and thereby miss a play.

Upon striking the cue ball, the resistance to movement of that ball will produce a "feedback" along the longitudinal geometrical axis of the ball striking cue. This "feedback" is perceived by the hands of the player to help him to gauge the level of energy to be applied to the cue ball to complete a given play. Indeed, no ball striking cue is perfectly rigid whereby a cue, in particular the shaft section thereof, will bend upon striking the cue ball to thereby produce mechanical vibrations ("resonance") perceived by the player's hand to give to that player a "feeling" of each impact between the tip of the ball striking cue and the cue ball. As bending of the ball striking cue is proportional to the level of energy involved in the impact, the player will also "feel" this level of energy. It is said that a ball striking cue has a good "resonance" when:

the level of vibrations is not sufficiently high to render control of the above mentioned various effects difficult; and the vibratory wave front propagating through the ball striking cue is not perturbed.

Because of its particular composition, wood is well suited for the fabrication of ball striking cues. More specifically, wood provides the required characteristics of "response" and "resonance". Although ball striking cues made of other materials are available on the market, those made of wood are the most popular. Indeed, most of the players are considering that a one-piece ball striking cue made of wood presents the best equilibrium between the "response" and "resonance" properties.

However, a one-piece ball striking cue made of wood presents two major drawbacks: it is both bulky and susceptible of warping. To facilitate transport thereof, ball striking cues formed of butt and shaft sections made of wood and that can be easily dismantled and assembled have appeared on the market. Wide acceptance of these two-piece ball striking cues was rapidly noted. As bulkiness of such cues is reduced, transport and storage thereof is greatly facilitated. Moreover, the length of the pieces of wood, namely the butt and shaft sections being reduced, the tendency of such cues to warping is also reduced by 30% to 50% depending on the position of the joint between the butt and shaft sections.

Ideally, a two-piece ball striking cue should present the same properties, i.e. the same "response" and "resonance" as a one-piece cue made of the same wood. In practice, this requirement has not been met by the prior art since relatively simple mechanical joints have been used to replace the complex arrangement of wood fibers. This obviously changes the distribution of forces in the ball striking cue and accordingly the general behavior of the cue.

The prior art joints usually comprise threaded stud and hole formed on the proximate ends of the butt and shaft sections, respectively. To assemble the butt and shaft sections end to end, the threaded stud is screwed in the threaded hole. The prior art joints therefore comprise annular and flat abutment surfaces perpendicular to the longitudinal axis of the cue.

The "resonance" of a ball striking cue is mainly determined by the quality of the wood. Where the wood has a high uniform density and a substantially straight grain, the cue is rigid and stable. Upon an impact, vibrations are produced and propagate through the shaft section of the ball striking cue from the tip toward the butt section thereof. However, as the vibratory wave front reaches a prior art joint of which the density is different from that of wood, the laws of physics teach that propagation of the wave front will be perturbed by this sudden change of density of the transmission medium. Accordingly, the joint constitutes a parasitic element perturbing propagation of the wave front before it reaches the butt section and the hands of the player.

Also, the two annular abutment faces are perpendicular to the wood fibers and connected together only through the threaded stud and hole whereby they form a barrier impeding propagation of the vibratory wave front from the shaft section to the butt section.

Moreover, upon an impact between the tip of the ball striking cue and the cue ball, the feedback tends to separate the two annular flat abutment faces to an extent depending on the level of energy involved.

Depending on the material used to fabricate a prior art joint, the "response" and/or "resonance" is affected. For example, prior art joints made of stainless steel form a cue having an excellent "response" but a sharp and hard "resonance"; it is then said that the cue "gives to the player a lot of ball contact feeling". Regarding prior art plastic joints, for example made of Implex (Trademark), Delrin (Trademark) and multipolymers, they provide a "resonance" close to that of one-piece wood cues but reduce the "response".

OBJECT OF THE INVENTION

The main object of the present invention is therefore to eliminate the above discussed drawbacks of the prior art joints.

SUMMARY OF THE INVENTION

More specifically, in accordance with the present invention, there is provided a ball striking cue comprising a butt section, a shaft section, and a self-locking joint for removably interconnecting the butt and shaft sections end to end along a longitudinal geometrical axis. This self-locking joint comprises: a proximate end of one of the butt and shaft sections having an axial hole defining a bottom and an uniformly widening-out inner surface; and a proximate end of the other of the butt and shaft sections having an axial extension including a free end and an uniformly tapering outer surface.

The inner and outer surfaces have complementary shapes and the inner surface has smaller radial dimensions than the outer surface whereby the outer surface is forced axially in the inner surface to press fit the outer surface in the inner surface and thereby removably interconnect the butt and shaft sections with a gap between the bottom and free end. Also, the degree of widening-out of the inner surface and of tapering of the outer surface is function of the nature of the material forming the inner and outer surfaces to enable press fit and retention of the outer surface in the inner surface while enabling separation of the inner and outer surfaces by forcing these surfaces axially apart from each other.

It has been discovered that a joint formed by complementary widening-out inner surface and tapering outer surface does not substantially affect the "response" and "resonance" properties of a ball striking cue.

Preferably, the inner and outer surfaces constitute the unique point of contact between the butt and shaft sections, the inner and outer surfaces are conical, the axial extension is provided on the proximate end of the butt section, and the axial hole is provided on the proximate end of the shaft section.

In accordance with another preferred embodiment of the ball striking cue according to the invention, the proximate end of one of the butt and shaft sections comprises an outer threaded axial cylindrical surface on which an internally threaded sleeve is mounted, and the other of the butt and shaft sections comprises an annular abutment surface facing one end of the sleeve. Rotation of the internally threaded sleeve on the threaded cylindrical surface causes axial displacement of the sleeve on the threaded surface and abutment of the end of that sleeve against the abutment surface and then axial spreading apart of the inner and outer surfaces.

The objects, advantages and other features of the present invention will become more apparent upon reading of the following non restrictive description of a preferred embodiment thereof, given by way of example only with reference to the accompanying drawings.

BRIEF DESCRIPTION OF THE DRAWINGS

In the appended drawings:

FIG. 3 is a longitudinal cross sectional view of the self-locking joint of the ball striking cue of FIG. 1, in an interconnected position.

DETAILED DESCRIPTION OF THE PREFERRED EMBODIMENT

Figure 1:
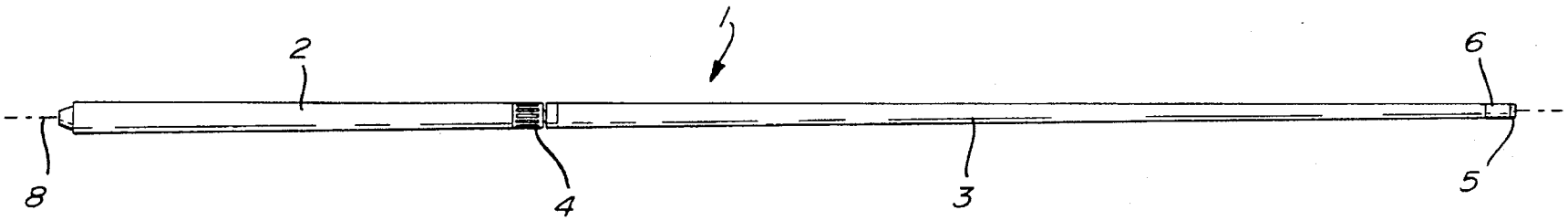
FIG. 1 is a side elevational view of a two-piece ball striking cue in accordance with the present invention, comprising a detachable self-locking joint.

As illustrated in FIG. 1, the ball striking cue 1 according to the invention comprises an elongate butt section 2 and an elongate shaft section 3 removably interconnected end to end along a longitudinal geometrical axis 8 by means of a detachable self-locking joint 4. The ball striking cue 1 further comprises a tip 5 mounted to the free end of the shaft 3 through a ferrule 6.

Figure 2:
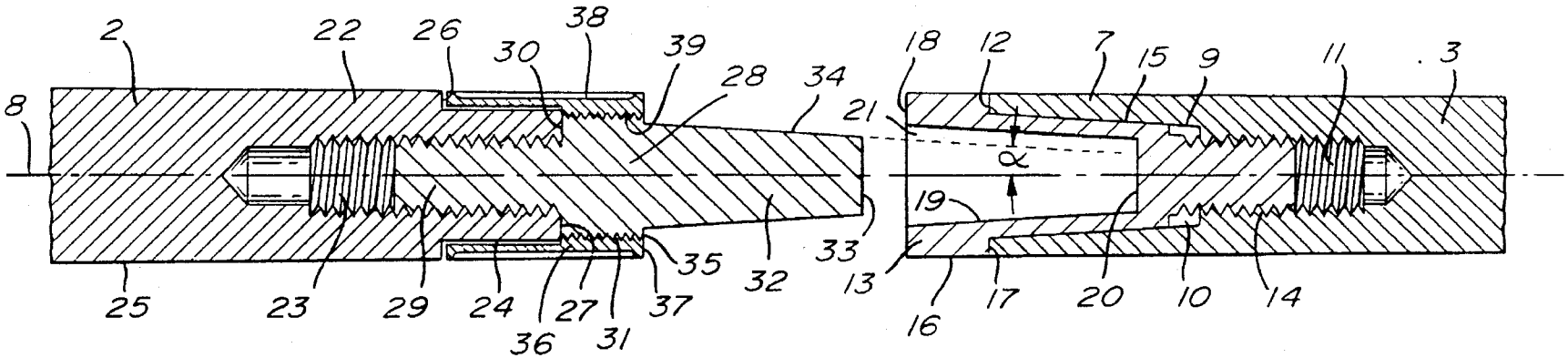
FIG. 2 is a longitudinal cross sectional view of the self-locking joint of the ball striking cue of FIG. 1, in a spread apart position.
Figure 5:
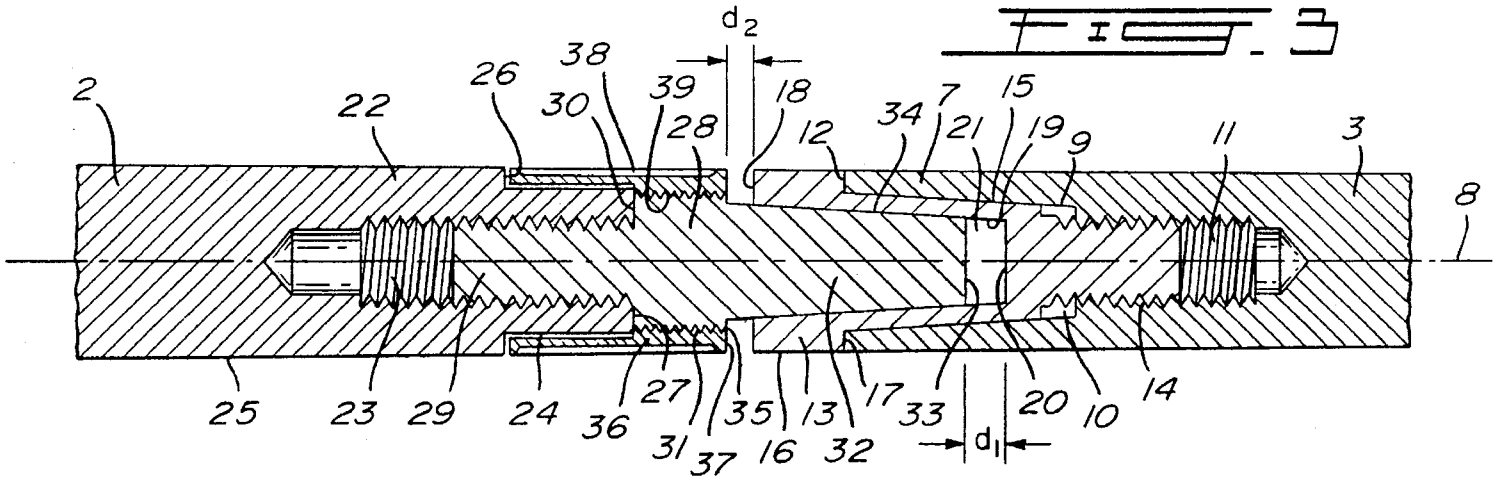

Referring to FIG. 2 of the appended drawings, the shaft section 3 comprises a proximate end 7 formed with an axial hole 9 therein. This axial hole 9 comprises a conical inner surface 10 and a threaded cylindrical inner surface 11 both centered on the axis 8. The end 7 of the shaft section 3 further defines a flat annular surface 12 perpendicular to the longitudinal axis 8.

The detachable self-locking joint 4 includes a first joint portion 13 mounted in the hole 9. Joint portion 13 is formed with a threaded cylindrical outer surface 14 to be screwed on the inner cylindrical surface 11, and with a conical outer surface 15 to be snugly fitted into the conical inner surface 10 of the hole 9. Joint portion 13 further defines a cylindrical outer surface 16 having substantially the same diameter as the proximate end 7 of the shaft section 3, and delimited by a circular shoulder 17 between the conical and cylindrical outer surfaces 15 and 16 and an annular abutment surface 18. Shoulder 17 and surface 18 are flat and perpendicular to the longitudinal axis 8.

In order to mount the joint portion 13 on the proximate end 7 of the shaft section 3, the threaded cylindrical outer surface 14 of joint portion 13 is screwed into the threaded cylindrical inner surface 11 of hole 9 until shoulder 17 abuts against surface 12. Snugly fitting of the conical outer surface 15 into the conical inner surface 10 as well as abutment of shoulder 17 and surface 12 against each other center the joint portion 13 on the longitudinal axis 8. Glue is introduced between the outer surface of joint portion 13 and the inner surface of hole 9 to firmly secure the joint portion 13 in the hole 9.

Finally, the exposed end of the joint portion 13 is formed with an axial hole 19 defining a bottom 20 and an uniformly widening-out conical inner surface 21 whose function will be described in the following description.

Still referring to FIG. 2 of the appended drawings, the butt section 2 comprises a proximate end 22 formed with an axial threaded cylindrical hole 23 therein. The end 22 of butt section 2 is further formed with a cylindrical surface 24 of smaller diameter defining with the taper surface 25 of the butt section 2 a circular shoulder 26. The proximate end 22 of the butt section 2 is also formed with a flat annular surface 27 perpendicular to the longitudinal axis 8.

The detachable self-locking joint 4 comprises a second joint portion 28 mounted in the hole 23. Joint portion 28 is formed with a threaded cylindrical stud 29 to be screwed in the threaded hole 23, and with a flat circular shoulder 30 perpendicular to the axis 8, to be applied to the flat surface 27. Joint portion 28 further defines a threaded cylindrical outer surface 31 extending from the shoulder 30 exteriorly of the hole 23. Therefore, threaded surface 31 has a diameter larger than that of stud 29. Extending from the threaded surface 31 is an axial extension 32 having a flat free end 33 and an uniformly tapering conical outer surface 34. A circular flat shoulder 35 perpendicular to the axis 8 is defined between the threaded cylindrical surface 31 and the conical extension 32.

In order to mount the joint portion 28 on the proximate end 22 of the butt section 2, one has only to screw the threaded stud 29 of joint portion 28 in the threaded cylindrical hole 23 until shoulder 30 abuts against surface 27 of the proximate end 22 of the butt section 2. Abutment of the surface 27 and shoulder 30 against each other will center the threaded cylindrical surface 31 and the extension 28 on the longitudinal axis 8. Glue is introduced between the outer surface of joint portion 28 and the inner surface of hole 23 to firmly secure the joint portion 28 in the hole 23.

A cylindrical axial sleeve 36 extends between shoulders 26 and 35 to enclose the cylindrical surfaces 24 and 31. Sleeve 36 has an inner surface portion 39 which is threaded to be screwed onto the threaded surface 31. Also, sleeve 36 comprises a free end abutment surface 37 and a plurality of circumferentially distributed longitudinal grooves such as 38 providing for manual gripping of the sleeve 36 upon rotation thereof about longitudinal axis 8.

A first function of the sleeve 36 is to make the joint 4 aesthetic by covering the surfaces 24 and 31. Its second function is to spread the inner and outer conical surfaces 21 and 34 apart from each other as will be described hereinafter.

As illustrated in FIG. 3, the butt and shaft sections 2 and 3 are assembled by inserting the conical extension 32 in the conical hole 19. As can be seen, the inner 21 and outer 34 conical surfaces have complementary shapes but the inner conical surface 21 has smaller radial dimensions than the outer conical surface 34. Therefore, the outer surface 34 can be forced axially in the inner surface 21 to press fit the extension outer surface 34 in the inner surface 21 of the hole 19 and thereby removably interconnect the butt and shaft sections with a gap $d_1$ between the bottom 20 of the hole 19 and the free end 33 of the extension 32 and with a gap $d_2$ between (a) the abutment surface 18 and (b) the circular shoulder 35 and abutment surface 37. It should be pointed out here that the degree (angle $\propto$ of FIG. 2) of widening-out of the inner surface 21 and of tapering of the outer surface 34 is function of the nature of the material forming the inner 21 and outer 34 surfaces to press fit, jam and retain the outer surface 34 in the inner surface 21 while enabling separation of the inner 21 and outer 34 surfaces by forcing these surfaces axially apart from each other. Joint 4 is accordingly self-locking.

As can be appreciated by one of ordinary skill in the art, the angle of widening-out of the conical inner surface 21 and the angle of tapering of the conical outer surface 34 must be equal to form an efficient conical connection. As illustrated in FIG. 3, the inner 21 and outer 34 conical surfaces advantageously constitute the unique point of contact between the butt 2 and shaft 3 sections to ensure that the conical connection is completed by inserting sufficiently the conical outer surface 34 in the conical inner surface 21.

When the conical surfaces 21 and 34 are difficult to separate, the internally threaded sleeve 36 is rotated about the longitudinal axis 8 on the threaded cylindrical surface 31 to displace the sleeve 36 axially until its free end surface 37 abuts against surface 18 of joint portion 13. From that point, further rotation of the sleeve 36 will cause axial spreading apart of the inner 21 and outer 34 conical surfaces. The sleeve 36 is particularly useful when the players, for example women or children, are not strong enough to manually spread the two joint portions 13 and 28 axially apart from each other.

The force required for spreading the joint portions 13 and 28 axially apart from each other should be as constant as possible from one ball striking cue to the other. It should also be determined to enable easy separation of the joint portions through the sleeve 36 by men, women and children.

This force required for spreading the joint portions 13 and 28 apart is caused by self-locking of the extension 32 in the hole 19 and is function of both the angle $\propto$ (FIG. 2) of the conical surfaces 21 and 35 with respect to the axis 8 and to the nature of the material forming these surfaces. Each surface of material has a friction coefficient depending on both the nature of the material and the rugosity of the surface. Some materials will also produce adherence between the two conical surfaces 21 and 34 even if they are polished. The elasticity of the materials should also be considered as joint portion 13 is susceptible of pressing the extension 32 of joint portion 28. Accordingly, the force of retention of the extension 32 in the hole 19 is influenced by many factors and is therefore very difficult to calculate accurately. Only an approximation of the value of that force can be obtained theoretically. Trial and error therefore constitutes the solution for adjusting the angle $\propto$ (FIG. 2) in function of the material(s) used.

Example

As discussed in the brief description of the prior art, the butt and shaft sections 2 and 3 are advantageously made of wood. However, it is within the scope of the present invention to use other materials.

The joint portion 28 may be made of ABS, PVC, Delrin, multipolymer of the Implex type, and brass. Excellent results are obtained with Delrin and brass. In the case of Delrin, the joint portion 28 should be reinforced by a central axial metal set screw (not shown). A joint portion 28 made of brass is preferably hollow (formed with a central axial hole therein (not shown)) to reduce the weight thereof.

The joint portion 13 may be made of ABS, PVC, multipolymer of the Implex type, and linen based phenolic rolled rod. Excellent results are obtained with linen based phenolic rolled rod because of its excellent tension properties; let us remind that joint portion 13 is tensioned. Another advantage of linen based phenolic rolled rod is its ability of being varnished.

The sleeve 36 may be made of ABS, PVC, multipolymer of the Implex type, aluminum, stainless steel and brass. All these material are capable of being internally threaded to fulfill the intended purpose. However, multipolymer has the advantage that it is available in a color imitating that of ivory.

For the purpose of exemplification only, a prototype having a joint portion 28 made of Delrin, a joint portion 13 made of linen based phenolic rolled rod, a sleeve made of multipolymer, and an angle $\propto$ of about 2° 40' have proved to be operational and provide good performance.

Generally speaking, for any combination of the materials mentioned in the foregoing description, an angle situated between 2° and 3° 30' will be adequate. However, it is within the scope of the present invention to use angles ∝ situated outside this range and any other material.

Operation

To construct a two-piece ball striking cue 1 having the same "response" and "resonance" properties as a one-piece ball striking cue made of wood, the self-locking joint 4 should reproduce as closely as possible the physical and mechanical properties of the wood of which the butt and shaft sections 2 and 3 are made to cause no discontinuity susceptible to perturb propagation of the feedback and vibratory wave front through the cue 1.

As the composition of wood cannot be reproduced in a joint, the complex arrangement of wood fibers has been considered as a whole with given physical and mechanical properties in view of proposing a detachable self-locking joint 4 for removably interconnecting the butt and shaft sections while reproducing as closely as possible these physical and mechanical properties. The joint 4 has been designed in view of, if not completely eliminating, substantially reducing the undesirable influence of the joint on the "response" and "resonance" properties, and therefore on the "feeling" of the ball striking cue 1.

To that effect, the inventors have discovered that a ball striking cue provided with a joint comprising complementary and mutually interlocking uniformly widening-out inner surface and uniformly tapering outer surface substantially behaves as a one-piece ball striking cue made of wood. The material of which the joint is made has no influence on this behavior. The ball striking cue 1 behaves as a one-piece cue even if joints between joint portions 13 and 28 and the shaft 3 and butt 2 sections, respectively, exist since the joint portions 13 and 28 are firmly glued to the shaft 3 and butt 2 sections as explained in the foregoing description.

Figure 4:
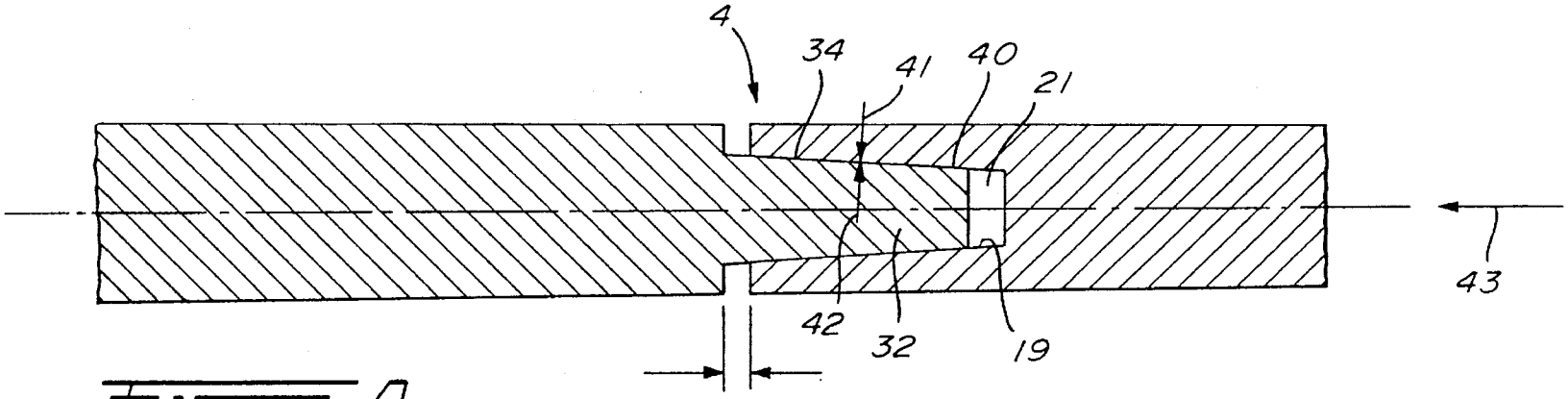
FIG. 4 is a longitudinal cross sectional view showing the concept of the detachable self-locking joint.

Reference will now be made to FIG. 4 of the appended drawings. In a static state, after the butt 2 and shaft 3 sections have been assembled end to end, analysis of the forces involved in the conical connection indicates the presence, at the interface 40, of two opposite forces 41 and 42 of equal amplitude and normal to the conical surfaces 21 and 34. These normal forces can obviously be split up into an axial component and a radial component in accordance with a given ratio.

Upon an impact between the tip 5 of the cue 1 and the cue ball (not shown), a feedback (axial force 43) is produced. As this feedback propagates toward the butt section 2 through the interface 40 of the joint 4, the amplitude of the force 41 increases and this force increment is transmitted to the butt section 2 (through increase of the opposite force 42) and then split up into axial and radial components according to the above mentioned given ratio. The hand of the player will feel the latter axial component only, constituting the above described feedback.

In the same manner, vibrations will be propagated through the interface 40 of the joint 4, by increasing and reducing the amplitude of the opposite forces 41 and 42. As the conical contact surfaces 21 and 34 are large and practically parallel to the fibers of the wood forming the butt and shaft sections 2 and 3, and as no relative transversal displacement between the hole 19 and the extension 32 is permitted, perturbation of the vibratory wave front as it propagates through the interface 40 is negligible.

The conical self-locking joint 4 of the cue 1 in accordance with the invention therefore distinguishes from the conventional joint in that it maximizes the amplitude of the radial component of the feedback and vibrations while minimizing the axial component whereby the effects of the joint 4 on the general "feeling" of the cue 1 are reduced. In other words, perception of the joint is minimized whereby only the feedback and vibrations caused by the tip 5 of the cue 1 striking the cue ball are felt as in the case of a one-piece ball striking cue made of wood.

As described in the foregoing description, prior art joints usually comprise threaded stud and hole formed on the proximate ends of the butt and shaft sections, respectively. To assemble the butt and shaft sections end to end, the threaded stud is screwed in the threaded hole. The prior art joints therefore comprise annular and flat abutment surfaces perpendicular to the longitudinal axis of the cue. For example, a prior art joint made of stainless steel will provide a cue with an excellent "response" but a sharp and hard "resonance", while a prior art joint made of plastic material such as Implex (Trademark), Delrin (Trademark) and multipolymers, will provide a "resonance" close to that of a one-piece wood cue but will tend to reduce the "response"

Accordingly, contrary to the prior art joints, the joint 4 according to the invention enables optimization of both the "response" and "resonance" characteristics of the cue.

Advantages

The ball striking cue 1 in accordance with the present invention present, amongst others, the following advantages:

- as the conical surfaces 21 and 34 are centered on the longitudinal axis 8, the butt 2 and shaft 3 sections are automatically and perfectly aligned along that axis when the outer surface 34 is press fit in the inner surface 21;
- when the conical outer surface 34 is press fit in the conical inner surface 21, relative lateral movement between the butt and shaft sections 2 and 3 is no longer possible;
- perturbation of the feedback and wave front by the joint 4 is negligible to preserve the "response" and "resonance" properties of the ball striking cue 1; and
- assembling and detaching of the joint is fast and easy.

Although the present invention has been described hereinabove by way of a preferred embodiment thereof, this embodiment can be modified at will, within the scope of the appended claims, without departing from the spirit and nature of the subject invention.

What is claimed is:

1. A ball striking cue comprising a butt section, a shaft section, and a self-locking joint for removably interconnecting the butt and shaft sections end to end along a longitudinal geometrical axis, said joint comprising:

a proximate end of one of the butt and shaft sections having an axial hole defining a bottom and an uniformly widening-out inner surface;

a proximate end of the other of said butt and shaft sections having an axial extension including a free end and an uniformly tapering outer surface;

wherein the inner and outer surfaces have complementary shapes and the inner surface has smaller radial dimensions than the outer surface whereby when the outer surface is inserted in the inner surface a gap exists between said bottom and free end, and wherein the degree of widening-out of the inner surface and of tapering of the outer surface is function of the nature of the material forming the inner and outer surfaces to enable (a) press fit of the outer surface in the inner surface by forcing the outer surface axially in the inner surface and (b) retention of the outer surface in the inner surface while enabling separation of the inner and outer surfaces by forcing said surfaces axially apart from each other; and wherein the proximate end of one of said butt and shaft sections comprises an outer threaded axial cylindrical surface on which an internally threaded sleeve is mounted, and wherein the other of said butt and shaft sections comprises an annular abutment surface facing one end of said sleeve, whereby rotation of the internally threaded sleeve on the threaded cylindrical surface causes axial displacement of the internally threaded sleeve on the threaded cylindrical surface and abutment of said one end of the internally threaded sleeve against said annular surface and then axial spreading apart of the inner and outer surfaces.

* * * * *